United States Patent [19]

Takahashi et al.

[11] 4,117,188

[45] Sep. 26, 1978

[54] LAPPED SEAM CAN

[75] Inventors: Yuzo Takahashi; Yoshimi Wazima; Akira Nakada; Yasuyuki Tanaka; Katsumi Nagai; Nobuo Takahashi; Hiroshi Matsuda; Eizi Aizawa; Shiro Oyama, all of Iwatsuki, Japan

[73] Assignee: Hokkai Can Co. Ltd., Tokyo, Japan

[21] Appl. No.: 781,520

[22] Filed: Mar. 25, 1977

[30] Foreign Application Priority Data

May 17, 1976 [JP] Japan ..... 51-56383
Jun. 17, 1976 [JP] Japan ..... 51-71336

[51] Int. Cl.[2] ..... B21D 51/32; B65D 7/36; B65D 7/44

[52] U.S. Cl. ..... 428/36; 138/145; 138/156; 220/79; 220/83; 428/129; 428/130; 428/188

[58] Field of Search ..... 220/75, 76, 79, 81 R, 220/62, 83, 77; 138/156, 169, 170, 164, 165, 145, 146; 428/35, 36, 129, 130, 188

[56] References Cited

U.S. PATENT DOCUMENTS

| | | | |
|---|---|---|---|
| 2,726,008 | 12/1955 | Atkinson | 220/81 R |
| 3,307,738 | 3/1967 | Scheindel | 220/77 X |
| 3,437,063 | 4/1969 | Battersby | 220/75 |
| 3,502,243 | 3/1970 | Erlandson et al. | 220/81 R |
| 3,763,895 | 10/1973 | Okubo et al. | 138/169 |
| 3,773,589 | 11/1973 | Kaiser et al. | 220/75 X |
| 3,819,085 | 6/1974 | Rottowetz | 428/480 X |
| 3,906,126 | 9/1975 | Kaiser et al. | 428/36 |
| 4,010,703 | 3/1977 | Spiekermann et al. | 220/77 X |
| 4,033,474 | 9/1977 | Rentmeester | 220/81 R |
| 4,055,271 | 10/1977 | Kronenwetter et al. | 220/77 X |

*Primary Examiner*—Harold Ansher
*Attorney, Agent, or Firm*—Stevens, Davis, Miller & Mosher

[57] ABSTRACT

A lapped seam can having a high safety characteristic used as containers of soft drinks or beer wherein the cut-burrs at the end of the inner end portion of the can blank are completely removed so that micro-leak passages apt to occur in the lapped seam can are shut off, thereby permitting a long term storage of the can content without deterioration by preventing metal from being dissolved out from said inner end portion.

5 Claims, 18 Drawing Figures

LAPPED SEAM CAN

The present invention relates to lapped seam cans in which the opposite ends of can blanks are lapped one on the other and joined together to form a seam by means of welded organic adhesive films coated thereon.

Recently, lapped seam cans which are formed by lapping and joining with welded organic adhesives the opposite ends of can blanks such as aluminum-, tin- or nickel-plated steel plates or TFS (tin-free steel) plates having surfaces treated with chromic acid or phosphoric acid are widely used as containers for soft drinks containing carbonic acid or beer which do not require sterilization after charging and, more recently, such lapped seam cans have come to be used as containers for fruit juice soft-drinks containing carbonic acid which are subjected to hot-water sterilization at temperatures above 75° C. Further, the lapped seam cans have come to be trially applied even to so-called "hot-packed" cans which are charged with the contents at temperatures above 95° C.

However, in such beverage cans subjected to sterilization, minute voids occurring in the double-seamed portion of the lapped seam may result not only in micro-leaks, but also in deterioration or rot of the contents due to invasion of bacteria through such micro-leak passages, thus probably leading to serious sanitary problems. Especially in the case of carbonic acid-containing fruit juice beverages, the internal pressure during the sterilization process may reach as high as 5–6Kg/cm$^2$ and the pressure may occasionally leak out through minute voids to form micro-leak passages. Particularly, in the case of hot-packed cans, a high temperature thermal hysteresis accelerates the formation of micro-leak passages and, therefore, a further improvement in the sealability of the double-seamed portion of a lapped seam has now come to be highly desirable than ever.

Further, in soft drinks such as Cola or drinks having unique flavors, such unique flavors are remarkably lost if only about 2ppm of iron is dissolved therein. Therefore, it is critical that the dissolved iron content should be limited to a level below 2ppm in order to maintain the commercial values of such drinks.

Especially in the case of carbonic-acid beverages containing natural apple juice subjected to sterilization for 20 minutes at 75° C. or natural apple juice subjected to hot-packing at about 95° C., if the protective coating on the inner surface of a can drum is incomplete leaving iron surfaces at, for example, the cut ends of the can blank, malic acid contained in the apple juice causes iron to be dissolved in the drinks, thus damaging the flavor thereof. Also, in the case of hot-packed cans, hydrogen will be produced under such conditions due to the corrosion of ironbased can material and the vacuum in the can may be reduced in less than 6 months, thus finally hydrogen swelling of the can occurs.

In the case of cans according to the prior art as shown in section in FIG. 11, can blanks are subjected to a heating process in the state as cut to a desired length without removing sharp cut-burrs which are unavoidably formed at the respective cut ends of the blanks on one side thereof and an organic adhesive film is stuck onto one side of the respective cut end portions of the blanks leaving a portion of the film to be folded back for coating the other side. Then, the adhesive film is folded back and pressed to be stuck onto the other side of the blank through a series of rolls each having a sequentially varied pressure angle. Therefore, in order to prevent creases from occurring in the film stuck onto thus heated can blanks, it is necessary to keep stretched that portion of the film to be folded back and, to press the film against the ends of the blank with rolls. As a result, since the film necessarily comes into contact with the sharp cut-burrs occurring at the cut ends of the can blank, pin-holes will be formed in the film and metal will be dissolved out through these pin-holes into the can content. Hithereto, it has been impossible to prevent such pin-holes from occurring even by thickening the film.

Further, according to the prior art, voids 305, 306, 307 and 308 form in the double-seamed portion where the can end member is double-seamed and this portion together with the can body member of the can grows as the stepped bulge thickness of the double-seamed portion 304, 304 of the can increases, and the content of the can passes into these voids, thus readily tending to produce micro-leaks through passages 306-305-309-310 or 306-305-307-308. Also, since the seaming roll passing the lapped seam portion at a relatively high speed behaves as if it jumped at the beginning 311 and end 312 of the lapped seam portion, there is a tendency that the inner surfaces of the can body, top end and bottom end of the can are damaged at the lapped seam portion thereof and, from these damaged portions, iron may be dissolved out or pits may be produced due to corrosion. In FIG. 11, the reference numeral 313 is the can blank and 314 denotes the can cap.

The U.S. Pat. No. 3,763,895 proposes to widen the width of the film by several times the thickness of the inner and outer laps of the lapped seam portion for filling the voids. However, such a mere widening of the film width is neither effective for the purpose of sealing packing nor substantially contributes to the reduction in the bulge thickness of the lapped seam portion. Therefore, the damaging problem to the inner surfaces of the can body, top and bottom ends at the double-seamed portion remains unsolved.

According to the lapped seam cans proposed by the U.S. Pat. No. 3,819,085, a separate process is adopted to protect with adhesives the exposed surfaces of the cut end portions of the can blank, which renders the production process more complicated. Further, since particular consideration is not given to the bulge of the double-seamed portion in said U.S. patent, there are shortcomings that will cause damage to the inner surfaces during the double-seaming process and micro-leaks may occur through voids in the double-seamed portion.

Accordingly, an object of the present invention to provide lapped seam cans having a high degree of safety in which microleak passages which will form in conventional lapped seam cans adopting adhesives are eliminated so that the can content does not deteriorate or rot even over a long period of storage, thereby safeguarding the consumer's health, and avoiding any economic losses on the part of manufacturers.

Another object of the present invention lies in the prevention of damage to the inner surfaces in the vicinity of the double seamed portion of the lapped seam, can end and can body during the double-seaming process.

Still another object of the present invention is to prevent substantially completely metal from being dissolved from inner ends of the TFS plate and, thereby, to permit a long term storage of can content in a sound state.

These and other objects and features of the present invention will be apparent from the following detailed description of the invention taken with reference to the accompanying drawings, in which.

Figure 4:
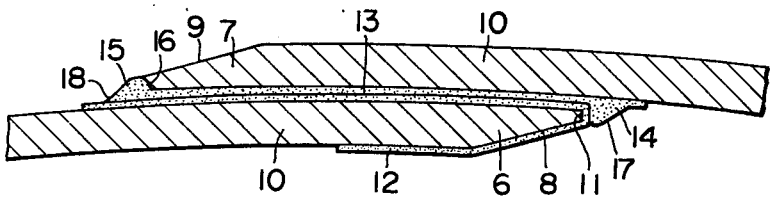
Figure 5:
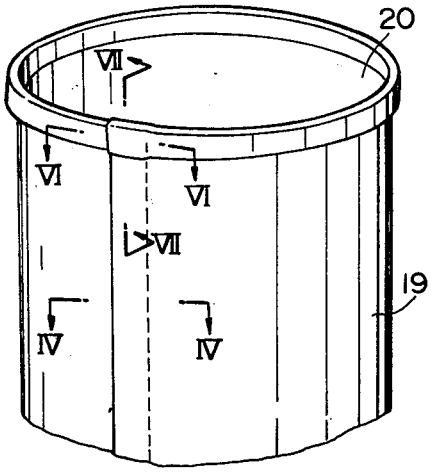
Figure 7:
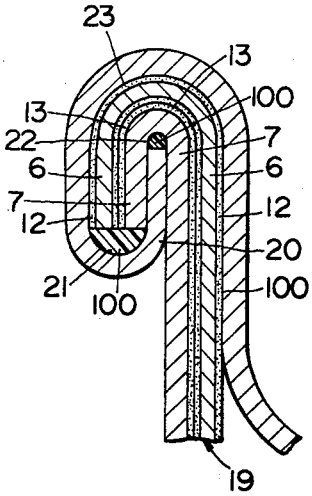
Figure 6:
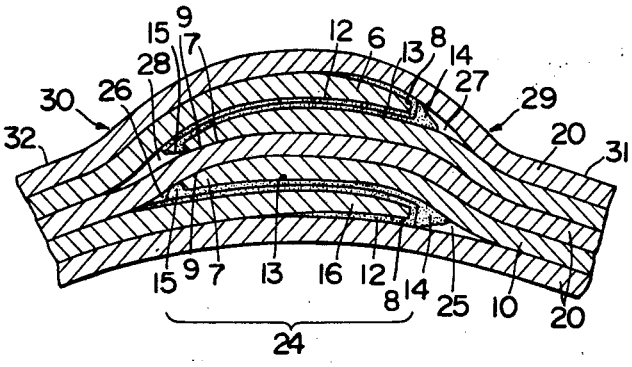
Figure 8:
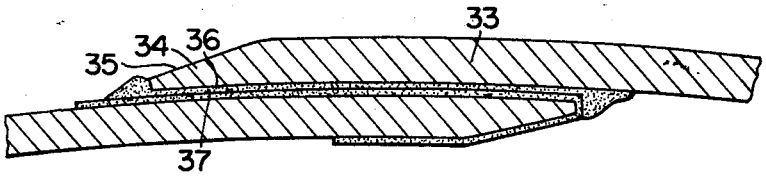
Figure 9:
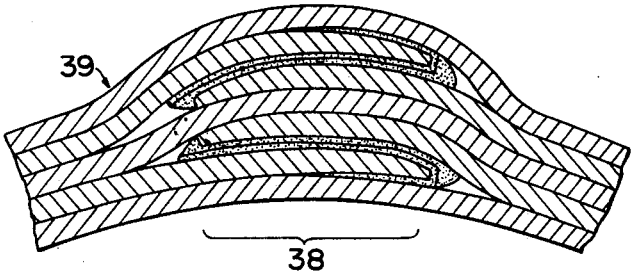
Figure 10:
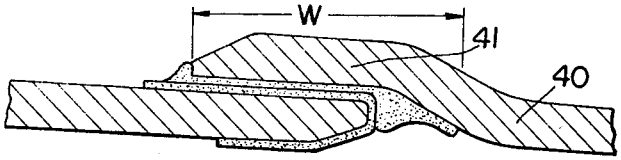
Figure 11:
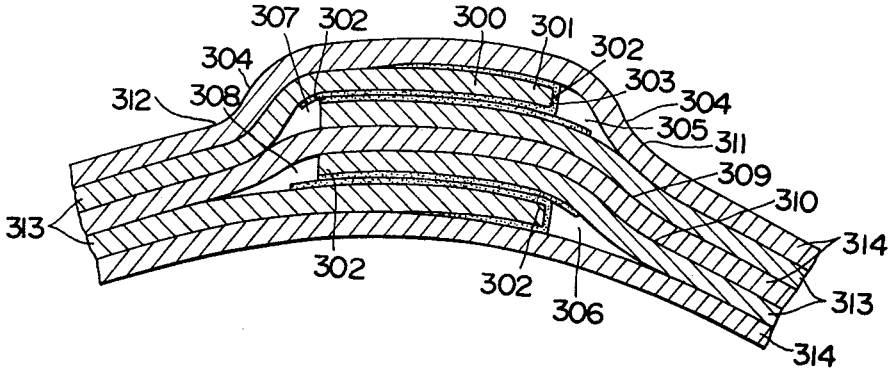
Figure 12:
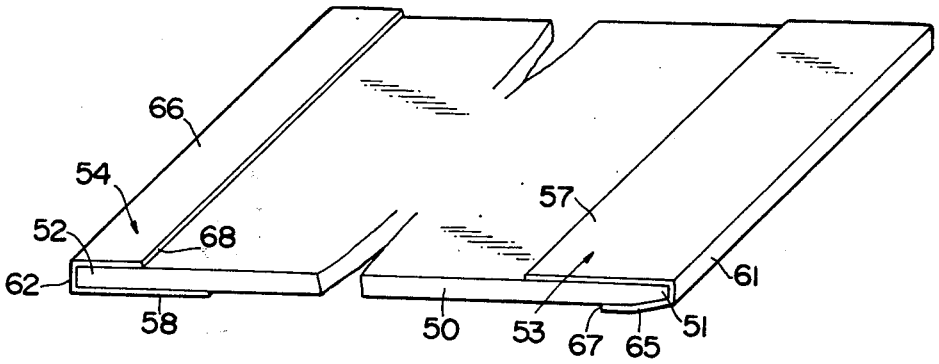
Figure 13:
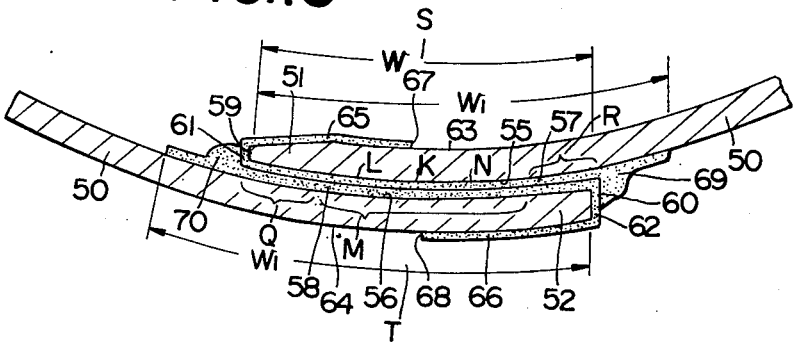
Figure 14:
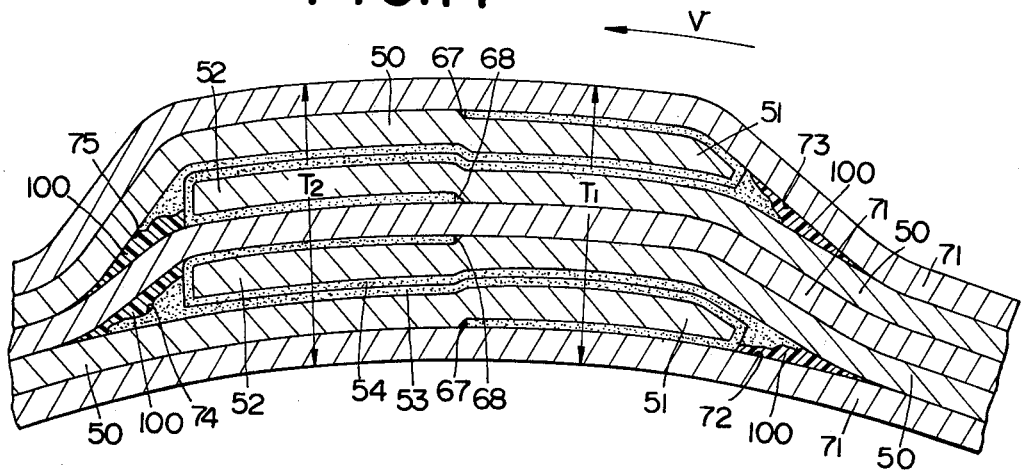
Figure 15:
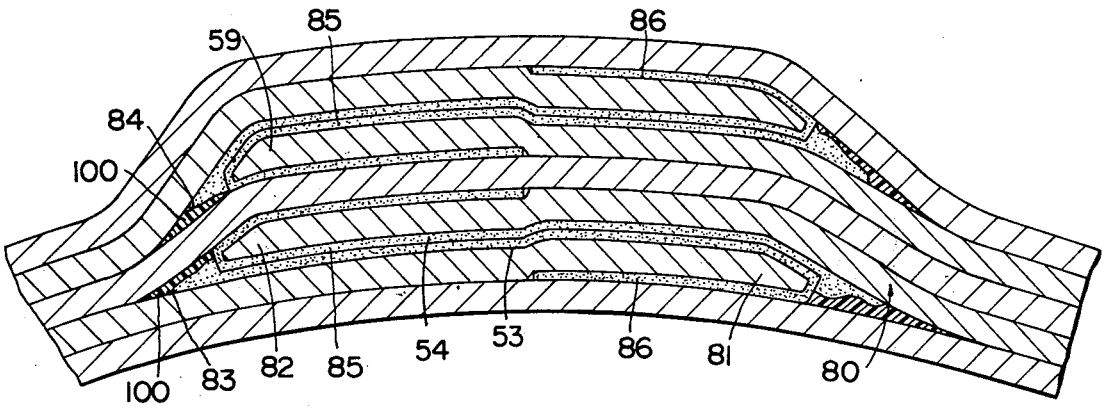

FIG. 3 (*a*) through (*d*) are side views of the can blank showing the sequence of steps in the rolling process;

FIG. 4 is a cross section of the lapped seam portion of a preferred embodiment of the lapped seam can according to the present invention taken on the line IV—IV of FIG. 5;

FIG. 5 is a perspective of the lapped seam can according to the present invention showing the upper part thereof;

FIG. 6 is a cross section taken on the line VI—VI of FIG. 5;

FIG. 7 is a cross section taken on the line VII—VII of FIG. 5;

FIG. 8 is a cross section of the lapped seam portion of a second embodiment of the lapped seam can according to the present invention;

FIG. 9 is a cross section of the double-seamed portion of the lapped seam portion shown in FIG. 8;

FIG. 10 is a cross section of the lapped seam portion of a third preferred embodiment of the lapped seam can according to the present invention;

FIG. 11 is a cross section of the double-seamed portion of an example of conventional lapped seam cans;

FIG. 12 is a perspective of an example of the can blanks showing the state thereof immediately prior to can forming;

FIG. 13 is a cross section of the lapped seam portion of a fourth preferred embodiment of the lapped seam can according to the present invention adopting the can blank shown in FIG. 12;

FIG. 14 is a cross section of the double-seamed portion of the lapped seam portion shown in FIG. 13; and FIG. 15 is a cross section of the lapped seam portion of a fifth preferred embodiment of the lapped seam can according to the present invention.

Figure 1:
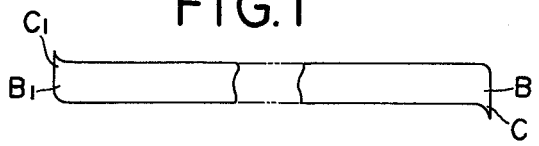
FIG. 1 is a schematic view of a can blank cut to a predetermined length from an elongated blank material.

Referring now to the drawings, the can blank 10 of the lapped seam can according to the present invention is first cut to a predetermined length from an elongaged blank material as shown in FIG. 1. At the opposite ends (B), ($B_1$) of the first blank (A) thus cut to the predetermined length, cut-burrs (C), ($C_1$) are formed. One end ($B_1$ in this example) of said ends of the first blank (A) is sequentially pressed as shown in FIG. 3 (*a*) through (*d*) through a series of forming rolls as indicated by 1 in FIG. 2 so that the blank end ($B_1$) can be press-formed to a desired state within a range from an extent at which the cut-burrs ($C_1$) is completely removed to another extent where the blank end ($B_1$) has a thickness about one-third of the original thickness of the first blank (A). In order to minimize the voids in the double-seamed portion it is preferred that the end portion ($B_1$) of the can blank 10 is shaped in a knife-edge-form to reduce the bulge thickness of the lapped portion. However, since a remarkably strong force must be imposed on the blank end ($B_1$) to obtain such a knife-edge shape, the undercoat on that portion shaped in the knife-edge form may be peeled off or minute metal filings may stick to the blank.

The inventor of the present invention conducted extensive experiments to determine the relationship between the degree of the press working on the can blank end and the sealing filling effect due to the bulging-out of the organic adhesives during the heated fusion-welding of the overlapped organic adhesive films. As a result of these experiments, the inventor succeeded in resolving the aforementioned shortcomings of the prior art and in making a lapped seam can having a superior double-seaming characteristic and micro-leak resistance by press-forming the blank end to such an extent at which the blank end ($B_1$) has a thickness about one-third of the original thickness of the first blank (A) without necessarily shaping the end portion to the knife-edge form.

The forming roll device 1 is arranged so that an inclined forming surface 5 of a forming roll 4 presses the end ($B_1$) of the can blank (A) as it passes through the gap defined by the opposing bearing roll 3 and forming roll 4. A plurality of such rolls 4 are provided in parallel and, by sequentially changing the angle of inclination ($\theta$) of the forming surfaces 5 of these rolls 4, the blank cut end ($B_1$) is press-formed to such an extent at which the blank end 6 has a thickness (*h*) about one-third of the original thickness (H) of the first blank (A), as shown in FIG. 3 (*a*) through (*d*).

Thus, a desired degree of press-forming is feasible by using a corresponding number of forming rolls 4 having corresponding angles of inclination to the desired thickness (*h*).

Figure 2:
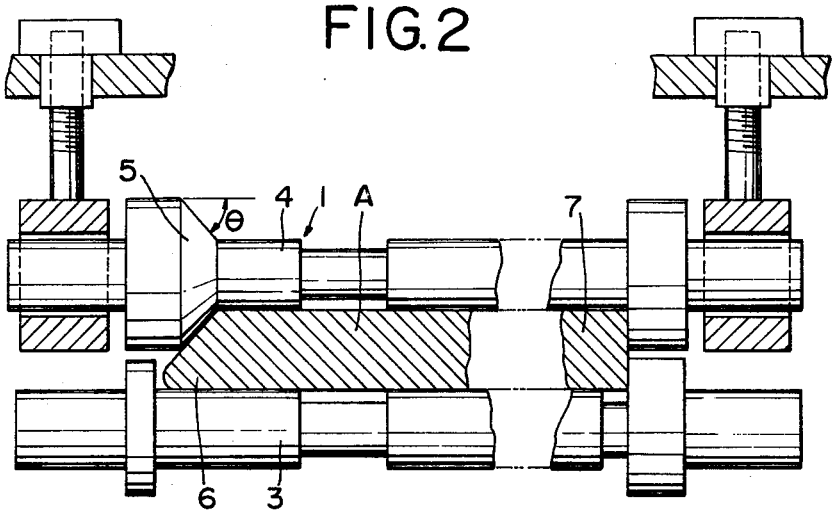
FIG. 2 is a longitudinal section of an example of a forming roll device showing a part thereof.
Figure 3A:
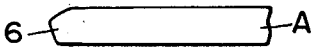
Figure 3C:
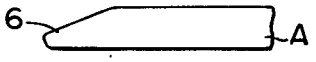
Figure 3B:
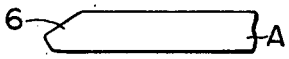
Figure 3D:
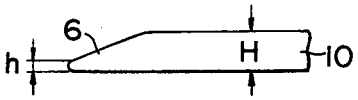

In FIG. 2, the can blank (A) is shown as having only one end 6 press-formed without processing the other end 7. However, it will be understood that the both cut ends 6 and 7 are press-formed into inclined faces 8 and 9 as shown in FIG. 4.

As shown in FIG. 4, in the lapped seam cans according to the present invention, the end portion 6 of the can blank 10 to be disposed at the inner side of the can has the inclined surface 8 inclined from inside to outside and an organic adhesive film 12 is stuck onto said end portion 6 by means of an organic adhesive film sticking device and a can body forming device so as to cover the inner and outer surfaces of the end portion 6 including the end face 11 thereof. Also, onto the inner surface of the outer end portion 7 of the can blank 10 which is to be overlapped onto the inner end portion 6, an organic adhesive film 13 of the same quality as the film 12 is stuck. In joining these two end portions 6 and 7, raised portions 14 and 15 of the organic adhesive film 13 are continuously coupled to the end face 11 of the cut end portion 6 and the end face 16 of the end portion 7, respectively, and also to the layer of the organic adhesive film 12 on the inclined surface 8 and to the inclined surface 9 of the outer end portion 7 of the can blank, respectively, so as to form continuous inclined surfaces 17 and 18.

The aforementioned can blank 10 is formed into a lapped seam can 19 as shown in FIG. 5 through a forming means to be described herein below.

The can blank 10 having the end portions thereof shaped as mentioned hereinbefore is first fed to a high frequency induction heating device which is adapted to heat only the end portions without overheating the portions corresponding to corners of the can blank, and one end of the can blank is inserted into an organic adhesive film material which is fed on a guide means in a state folded in U-shape or V-shape beforehand and the film is pressed against the blank.

At the same time, another organic adhesive film sheet is stuck onto the other end portion of the can blank.

The can blank having the both ends thereof coated with the adhesive films if transferred as a flat plate to a coil-type high frequency induction heating device which is adapted so as not to overheat the corner portions of the can blank, where the both end portions are heated to a temperature above the melting point of the adhesive film. In this case, the end portion totally covered with the film, namely, the end portion to be disposed at the inner side of the can, is heated to a temperature slightly lower than the temperature at which the outer end portion of the blank is heated, so that the aforementioned raised portions 14 and 15 can be formed.

As the organic adhesive film material, a crystalline polymer is used, and the temperature difference between the adhesive films on the inner and outer end portions of the blank is dependent upon the crystallinity of the particular adhesives used.

The can blank having the adhesive films on the opposite ends thereof heated and melted are fed as a flat plate to a can body forming assembly comprising wing-like members and forming horns which has a cooling effect only in the outward radial direction thereof at the lower spline portion.

In this forming assembly, the can body blank is formed into a cylindrical shape by the forming horn through the rocking motion of the wing-like members and the end portions are overlapped one on the other, and a cooled hammer holds and presses the end portions to cool and cure the adhesive films so as to form a lapped seam can body 19.

Then, a can cap 20 is secured through a double-seaming process onto the can body 19 formed in the manner as mentioned above, as shown in FIG. 5. Also, as shown in FIG. 7, a sealing compound 100 is applied on the abutting surface between the can body 19 and the cap 20 during the double-seaming process, so that the entrapped portions 21 and 22 and said abutting surface 23 can be hermetically sealed.

As shown in FIG. 6, in the lapped seam can according to the present invention, the cut-burrs (C), ($C_1$) are removed from the can body blank through the press working and raised portions 14 and 15 which are continuous to the inclined surfaces 8 and 9, respectively, are formed on the organic adhesive film 13, as described hereinbefore. Therefore, the voids 25, 26, 27 and 28 to be formed on the sides of the end portions 6 and 7 of the can body blank at the lapped seam portion 24 after the double-seamed portion are rendered remarkably narrow due to the existence of said raised portions 14 and 15. At the same time, by the press working of the end portions 6 and 7 of the can body blank, the stepped portions 29 and 30 on both sides of the lapped seam portion 24 continuous to the remaining parts of the double-seamed ring-like portion 31 and 32 can draw slack and smooth curves.

Since the voids 25, 26, 27 and 28 are rendered remarkably narrower as described above, the space in which the sealing compound 100 is placed becomes also narrower so that the voids can be totally sealed through the filling of the sealing compound 100. As shown in FIG. 6, the inclined surfaces 8 and 9 of the end portions 6 and 7 of the can body blank 10 are bent inwardly in the outer layer of the double-seamed portion under the working pressure during the double-seaming process so that the stepped portions 29 and 30 form slack curves.

In the second preferred embodiment of the lapped seam can according to the present invention as shown in FIGS. 8 and 9, the outer end portion 34 of the can blank 33 is plastically formed into the inclined surface 35 in a similar manner to the first preferred embodiment described previously. While, in the second embodiment, an inwardly curved portion 36 is formed in the end portion 34 so that said curved portion 36 intrudes into the organic adhesive film layer 37, thereby rendering the stepped portion 39 at the side of the lapped seam portion 38 smooth after the double-seaming process.

In the third preferred embodiment of the lapped seam can according to the present invention as shown in FIG. 10, a portion of the outer end portion 41 of the can blank 40 corresponding to the width (W) of the lapped portion is outwardly bent so that the bulge of the inner peripheral surface of the lapped seam portion of the can can be reduced.

A series of tests were conducted on the aforementioned preferred embodiments of the lapped seam cans according to the present invention. Tables 1, 2, 3 and 4 show the test results in terms of enamel rater value (ERV), Fe dissolution and micro-leak occurrence.

1. Tested cans (1) Can body blank material: Stel plate treated with electrolytic chromic acid (tinfree steel), 0.17mm thick
(2) Coating: Epoxy phenol type paint coated on inside
(3) Adhesive coating: Nylon-12 type film, 50μ and 40μ thick, coating and heating temperature: 200° C.
(4) Can structure
Type A-1: Ends of the can body blank were pressed until the cut-burrs were removed.
Type A-2: Ends of the can body blank were pressed to reach the thickness about one-third of the first blank.
Type B-1: In the type A-1, the outer end portion of the can body blank was bent inwardly.
Type B-2: In the type A-2, the outer end portion of the can body blank was bent inwardly.
Type C-1: In the type A-1, the body blank was processed as shown in FIG. 10.
C-2: In the type A-2, the body blank was processed as shown in FIG. 10.
Control: Can body blank as cut (with cut-burrs) was formed into can.
(5) Can forming: Adhesive film on the inner end portion of the can blank was heated to 220° C. and adhesive film on the outer end of the can body blank was heated to 240° C.
(6) Top end: Aluminum, double-seamed in a conventional manner.
(7) Bottom end: Tin-free steel, double-seamed in a conventional manner.

2. Measurement of enamel rater value (ERV) and other items (1) With the top end down, 3% aqueous solution of electrolytic NaCl was filled in the can and stainless steel electrode was placed therein. Voltage of 6.2VDC was applied across the positive can and the negative electrode and the current was measured. The results are given in Table 1.
(2) With the bottom end down, the current was measured in a similar manner to the paragraph 1. The results are given in Table 2.
(3) Cola was filled in the can and the can was stored for 6 months with the bottom end down. Then, the Fe dissolution was measured. The results are given in Table 3.

(4) After filling the can with cola, the occurrence of micro-leaks was checked. The results are given in Table 4. In the tests of the paragraphs 1 and 2, the occurrence of any defective locations in the can was checked in terms of generation of hydrogen bubbles by setting the can to the negative potential.

Table 1

| | | | ERV measured with top end (Aluminum) down | | | | | | | (D-S : Double-seamed) | | | |
|---|---|---|---|---|---|---|---|---|---|---|---|---|---|
| | | | ERV | | | ERV distribution and number of cans | | | | Defective can location with ERV above 0.2mA | | | |
| Tape thickness | Can type | | Number of cans | Average | Range | Above 0.2mA | 0.2mA ~ 0.1mA | 0.1mA ~ 0.05mA | Below 0.05mA | Lap Edge | D-S lap edge | D-S portion | Others |
| 50 μ | Can of present invention | A-1 | 100 | 0.043 mA | 0–0.19 mA | 0 can | 5 can | 17 can | 78 can | 0 can | 0 can | 0 can | 0 can |
| | | A-2 | 100 | 0.043 | 0–0.17 | 0 | 8 | 15 | 77 | 0 | 0 | 0 | 0 |
| | | B-1 | 100 | 0.040 | 0–0.18 | 0 | 4 | 14 | 82 | 0 | 0 | 0 | 0 |
| | | B-2 | 100 | 0.042 | 0–0.16 | 0 | 3 | 18 | 79 | 0 | 0 | 0 | 0 |
| | | C-1 | 100 | 0.037 | 0–0.19 | 0 | 4 | 20 | 76 | 0 | 0 | 0 | 0 |
| | | C-2 | 100 | 0.042 | 0–0.18 | 0 | 5 | 17 | 78 | 0 | 0 | 0 | 0 |
| | Control | | 100 | 0.111 | 0–0.98 | 5 | 20 | 21 | 54 | 1 | 2 | 1 | 1 |
| 40 μ | Can of present invention | A-1 | 100 | 0.049 | 0–0.19 | 0 | 10 | 15 | 75 | 0 | 0 | 0 | 0 |
| | | A-2 | 100 | 0.034 | 0–0.18 | 0 | 7 | 17 | 76 | 0 | 0 | 0 | 0 |
| | | B-1 | 100 | 0.043 | 0–0.19 | 0 | 6 | 20 | 74 | 0 | 0 | 0 | 0 |
| | | B-2 | 100 | 0.042 | 0–0.17 | 0 | 3 | 21 | 76 | 0 | 0 | 0 | 0 |
| | | C-1 | 100 | 0.049 | 0–0.19 | 0 | 6 | 22 | 72 | 0 | 0 | 0 | 0 |
| | | C-2 | 100 | 0.034 | 0–0.19 | 0 | 4 | 19 | 77 | 0 | 0 | 0 | 0 |
| | Control | | 100 | 0.106 | 0–1.05 | 13 | 25 | 20 | 42 | 4 | 5 | 2 | 1 |

Table 2

| | | | ERV measured with bottom end (TFS) down | | | | | | | (D-S : Double-seamed) | | | |
|---|---|---|---|---|---|---|---|---|---|---|---|---|---|
| | | | ERV | | | ERV distribution and number of cans | | | | Defective can location with ERV above 0.2mA | | | |
| Tape thickness | Can type | | Number of cans | Average | Range | Above 0.2mA | 0.2mA ~ 0.1mA | 0.1mA ~ 0.05mA | Below 0.05mA | Lap Edge | D-S lap edge | D-S portion | Others |
| 50 μ | Can of present invention | A-1 | 100 | 0.078 mA | 0–0.20 mA | 0 can | 21 can | 41 can | 38 can | 0 can | 0 can | 0 can | 0 can |
| | | A-2 | 100 | 0.077 | 0–0.19 | 0 | 20 | 42 | 38 | 0 | 0 | 0 | 0 |
| | | B-1 | 100 | 0.085 | 0–0.19 | 0 | 27 | 49 | 24 | 0 | 0 | 0 | 0 |
| | | B-2 | 100 | 0.086 | 0–0.19 | 0 | 26 | 45 | 29 | 0 | 0 | 0 | 0 |
| | | C-1 | 100 | 0.077 | 0–0.18 | 0 | 24 | 40 | 36 | 0 | 0 | 0 | 0 |
| | | C-2 | 100 | 0.87 | 0–0.19 | 0 | 29 | 38 | 33 | 0 | 0 | 0 | 0 |
| | Control | | 100 | 0.169 | 0–1.54 | 9 | 28 | 44 | 19 | 2 | 5 | 2 | 0 |
| 40 μ | Can of present invention | A-1 | 100 | 0.088 | 0–0.20 | 0 | 24 | 38 | 38 | 0 | 0 | 0 | 0 |
| | | A-2 | 100 | 0.086 | 0–0.18 | 0 | 21 | 40 | 39 | 0 | 0 | 0 | 0 |
| | | B-1 | 100 | 0.076 | 0–0.20 | 0 | 25 | 47 | 28 | 0 | 0 | 0 | 0 |
| | | B-2 | 100 | 0.086 | 0–0.19 | 0 | 18 | 39 | 43 | 0 | 0 | 0 | 0 |
| | | C-1 | 100 | 0.084 | 0–0.19 | 0 | 24 | 45 | 31 | 0 | 0 | 0 | 0 |
| | | C-2 | 100 | 0.077 | 0–0.19 | 0 | 27 | 40 | 33 | 0 | 0 | 0 | 0 |
| | Control | | 100 | 0.326 | 0–2.54 | 17 | 32 | 34 | 17 | 7 | 6 | 2 | 2 |

Table 3

| | | | Fe dissolution | | | |
|---|---|---|---|---|---|---|
| Tape thickness | Can type | | Number of cans | Average dissolution (PPM) | Range (PPM) | Number of cans above 0.5 PPM |
| 50 μ | Can of present invention | A-1 | 30 | 0.24 | 0.09 – 0.44 | 0 |
| | | A-2 | 30 | 0.26 | 0.08 – 0.49 | 0 |
| | | B-1 | 30 | 0.30 | 0.04 – 0.54 | 1 |
| | | B-2 | 30 | 0.22 | 0.07 – 0.46 | 0 |
| | | C-1 | 30 | 0.24 | 0.07 – 0.53 | 1 |
| | | C-2 | 30 | 0.27 | 0.09 – 0.47 | 0 |
| | Control | | 30 | 0.35 | 0.14 – 0.75 | 3 |
| 40 μ | Can of present invention | A-1 | 30 | 0.26 | 0.08 – 0.52 | 1 |
| | | A-2 | 30 | 0.22 | 0.07 – 0.48 | 0 |
| | | B-1 | 30 | 0.30 | 0.09 – 0.55 | 1 |
| | | B-2 | 30 | 0.28 | 0.08 – 0.50 | 0 |
| | | C-1 | 30 | 0.27 | 0.10 – 0.64 | 1 |
| | | C-2 | 30 | 0.29 | 0.09 – 0.49 | 0 |
| | Control | | 30 | 0.42 | 0.09 – 0.96 | 5 |

Table 4

| | | | Occurrence of micro-leaks | | |
|---|---|---|---|---|---|
| | | | (M-L : micro-leaked) | | |
| Tape thickness | Can type | | Number of cans | Number of M-L cans | Percent defect |
| 50 μ | Can of present invention | A-1 | 500 can | 0 can | 0 % |
| | | A-2 | 500 | 0 | 0 |
| | | B-1 | 500 | 0 | 0 |
| | | B-2 | 500 | 0 | 0 |
| | | C-1 | 500 | 0 | 0 |
| | | C-2 | 500 | 0 | 0 |
| | Control | | 500 | 2 | 0.4 |
| 40 μ | Can of present invention | A-1 | 500 | 0 | 0 |
| | | A-2 | 500 | 0 | 0 |
| | | B-1 | 500 | 0 | 0 |
| | | B-2 | 500 | 0 | 0 |
| | | C-1 | 500 | 0 | 0 |
| | | C-2 | 500 | 0 | 0 |
| | Control | | 500 | 1 | 0.2 |

As shown in Tables 1 through 4, the lapped seam cans according to the present invention is not subjected to a surface coating damage and far superior to conventional lapped seam cans in respects of ERV, Fe dissolution and micro-leaks occurrence.

The aforementioned features of the lapped seam cans according to the present invention are combined effects of the facts that the cut-burrs are removed from at least the inner end portion of the can blank to eliminate the occurrence of pin-holes or breakage in the adhesive films, the bulge of the lapped seam portion is slackened to prevent the jump of rolls during the double-seaming process which tends to cause damages to inner surface coatings of the lapped seam portion, can body, top end or bottom end in the vicinity thereof, stress is not concentrated on the edge corner portions of the can blank during the sticking and double-seaming processes, the voids in the lapped seam portion are filled up with the raised portions of the adhesive film so that the cut end portions of the body blank can be totally covered, and that micro-leak passages are closed substantially completely by the sealing compound. Also, since the cut-burrs are removed from the end portions of the can blank, it is possible to stick a thin organic adhesive film onto the end portions and, therefore, the bulge of the lapped seam portion can be reduced.

Further, the press-working of the end portions of the can blank to a thickness about one-third of the original thickness thereof reduces the bulge of the lapped seam and minimize the voids therein and, therefore, the shape of the double-seaming portion can be rendered smooth to prevent the jumping of the seaming roll.

FIGS. 12 through 14 show a fourth preferred embodiment of the lapped seam can according to the present invention. Similarly to the previous preferred embodiments, the fourth embodiment uses a can body blank cut to a predetermined length and having the end portions thereof plastically deformed into an inclined shape. Also, the thickness of the end portion is reduced to a desired thickness greater than the lower limit of one-third of the original thickness.

As shown in FIG. 12, organic adhesive films 53 and 54 are stuck onto the opposite end portions 51 and 53 of thus formed can blank 50 so as to cover the same through an organic adhesive film sticking device.

Then, the opposite end portions 51 and 52 of the can blank 50 is overlapped one on the other in the can body forming device. In this case, the adhesive films 53 and 54 have a rectangular U-shape comprising portions 57 and 58 stuck onto the overlapped surfaces 55 and 56 with the width ($W_1$) wider than the lapping width (W), portions 61 and 62 stuck onto the end faces 59 and 60 of the can blank and portions folded portions 65 and 66 stuck onto the surfaces 63 and 64 opposite to said overlapped surfaces 55 and 56, respectively. The ends 67 and 68 of said folded portions 65 and 66 are disposed within the range of the lapped portion (M) excluding the zones (Q) and (R) inside the opposite limit ends of the lapping width (W) and adjacent thereto in such a manner that the ends 67 and 68 face each other within the zones defined between the position (K) where the line (S - T) including the axis of the can intersects perpendicularly the overlapped surfaces 55 and 56 and the positions (L) and (N) spaced apart by about one-fifth of the lapping width (W) from said position (K), respectively.

In the preferred embodiment shown in FIG. 13, the portions 57 and 58 of the organic adhesive films 53 and 54 are raised during the lapping process as indicated by 69 and 70 so as to form inclined surfaces relatively smoothly continuous to the outer surfaces of the folded portions 65 and 66.

FIG. 14 is a cross section of the double-seamed portion of the lapped seam after the can end 71 being secured onto the can body formed with the lapped seam as shown in FIG. 13 and double-seamed therewith. In FIG. 14, it is clearly shown that the opposite ends 67 and 68 of the folded portions 65 and 66 of the organic adhesive films 53 face esch other, as described hereinbefore, without overlapping each other and, at the same time, said organic adhesive films 53 and 54 having substantially indentical configurations to the respective ends 51 and 52 of the can body blank are coated onto the respective end portions of the can body blank so as to form a rectangular U-shape in section, thereby rendering the thickness of the entire double-seamed portion of the lapped seam substantially uniform.

That is to say, in FIG. 14, the layer structure to the right of the position of said end 67 and the opposite layer structure to the left of said end 68 have the same number of layers and the same thickness ($T_1$) and ($T_2$). Therefore, as the seaming roll moves in the direction of the arrow (V), the seaming roll can smoothly exert a uniform double-seaming force without leaping or jumping. Thus, the end portions 51 and 52 can be closely joined to the can end 71 and the organic adhesive layers 53 and 54 without causing voids therebetween, leaving only extremely small voids such as 72, 73, 74 and 75 at the positions of the end faces 59 and 60 of the end portions 51 and 52.

At these voids 72 through 75, the raised portions 69 and 70 of the organic adhesive film are located as described previously and the sealing compound 100 is interposed in the double-seamed portion in a conventional manner. Therefore, these voids 72 through 75 are filled up substantially completely.

FIG. 15 shows a fifth preferred embodiment of the lapped seam can according to the present invention. The fifth embodiment shown in FIG. 15 adopts a can blank 80 having the opposite ends thereof 81 and 82 formed with inclined surfaces, respectively. As shown in the drawing in cross section, the can body blank 80 is subjected to a double-seaming process together with the can end in a similar manner to the aforementioned preferred embodiments. In the fifth preferred embodiment, the voids 83 and 84 are rendered narrower than those of the preceding preferred embodiments.

Also, in the preferred embodiments shown in FIG. 14 and 15, by using an organic adhesive film 54 or 85 to be stuck onto the outer end 52 or 82 of the can body blank 50 or 80 having a thickness smaller than another organic adhesive film 53 or 86 to be stuck onto the other end 51 or 81, the left half portion of the double-seamed portion of the lapped seam can be rendered thinner than the right half as seen in the drawings and, therefore, the double-seamed pressing by the seaming roll passing in the direction of arrow (V) or ($V_1$) can be improved.

In the latter preferred embodiment according to the present invention, since the ends of the folded portions of the organic adhesive films stuck to cover the respective end portions of the can blank in a rectangular U-shape fashion are disposed within the lapping width so as to face each other without overlapping each other, a substantially uniform thickness can be attained over the entire lapped seam in the double-seamed portion and, therefore, the seaming roll can smoothly move thereon without leaping or jumping so that the double-seam pressing can be positively effected over the entire lapping width. Further, a uniformly laminated structure can be obtained through the entire double-seamed portion of the lapped seam without a difference in the number of layers. As a result of a combination of the aforementioned features, the voids occurring in the double-seamed portion of the lapped seam can be reduced to extremely minute size almost close to absence. Accordingly, even if the lapped seam can charged with the content is subjected to heating for sterilization and a high internal pressure is generated as a result thereof, no micro-leak passages will be formed. Thus, the micro-leak resistance of the can may be highly improved to such an extent that the intrusion of bacteria through micro-leak passages and the deterioration of the content can be prevented substantially completely.

Further, according to the aforementioned preferred embodiments of the present invention, the opposite ends of the folded portions of the adhesive films are disposed within the range of the lapping width excluding certain zones inside the opposite limit ends of the lapping width and adjacent thereto in such a manner that said opposite ends face each other within another zone defined between the position (K) where the plane including the axis of the can intersects the overlapped surfaces and the positions spaced apart in the opposite directions by one-fifth of the maximum lapping width from said position (K), respectively. Therefore, as far as said opposited ends of the adhesive film is located within said ranges, respectively, even if there is an interval between said opposite ends, such an interval will not cause the jumping of the seaming roll passing there and a probable void in said interval is filled with the sealing rubber substantially completely. Also, said interval gives a practicable processing error range to the sticking process of the organic adhesive films and, therefore, does not reduce the working efficiency.

Further, according to the present invention, since the seaming roll does not jump and smoothly, passes the double-seamed portion of the lapped seam during the double-seaming process, the inner surfaces of the can end or can body will not be damaged. In combination therewith, since the end faces of the opposite end portions of the can blank are completely covered with the organic adhesive films, the dissolution of the metal into the can content can be prevented substantially perfectly.

Also, in the lapped seam can according to the present invention, the opposite ends of the can blank are coated with the organic adhesive films having a rectangular U-shape in section and, therefore, a supplementary coating processing onto the outer end of the can blank as prevalent in the prior art can be omitted and the production of lapped seam cans having a uniform quality can be ensured.

Finally, comparative data on the micro-leaks occurrence between the preferred embodiment of the lapped seam can shown in FIG. 15 and the conventional lapped seam can are clearly presented in Table 5.

Table 5

| | | (M-L : micro-leaked) | | | | | |
|---|---|---|---|---|---|---|---|
| Contents | | Cola pack (internal pressure: 30Kg/cm$^2$) | | | Carbonic acid-containing fruit juice, hot water sterilization (internal pressure during sterilization: 5 – 6Kg/cm$^2$, at normal temperature: 3.75Kg/cm$^2$) | | |
| Can type | | Number of cans | Number of M-L cans | Percentage defective | Number of cans | Number of M-L cans | Percentage defective |
| Can of present invention in FIG.15 | | 500 can | 0 can | 0 % | 500 can | 0 can | 0 % |
| Controls | Can in FIG. 6 | 500 | 0 | 0 | 500 | 3 | 0.6 |
| | Can in FIG.11 | 500 | 2 | 0.4 | 500 | 24 | 4.8 |

Can body blank material: Steel plate treated with electorolytic chromic acid (tin-free steel), cola-packing can 0.17mm thick, carbonic acid-containing fruit juice packing can 0.23mm thick Can coating: Epoxy phenol type paint on both sides Adhesives: Nylon-12 type film 50$\mu$ thick, heating temperature: 200° C.

What we claim is:

1. A lapped seam can having the opposite end portions of the can blank joined together with organic adhesive films and a double seam portion comprising:

a first inclined surfaced end portion of said blank terminating in an end face the thickness of which is about one-third of the original thickness of the can blank;

a first organic adhesive film covering the inner and outer surfaces of said first end portion including the end face;

a second end portion of said blank having an end face;

a second organic adhesive film stuck onto the inner surface of said second end portion of the can blank coming outside of said first end portion at the lapped seam;

said first organic adhesive film stuck onto the outer surface of said inner end of the can blank joined to said second organic adhesive film;

said second adhesive film forming a raised portion on one end thereof and coupled to the end face of said inner end portion to form an inclined surface continuous to said inclined surface of said first end portion;

said second adhesive film forming a raised portion on the other end thereof and coupled to the end face of said outer end portion of the can blank;

said double-seam portion having a sealing compound interposed in voids formed between said two end portions of the can blank when double-seamed;

said voids also being filled up with said adhesive film layers;

the opposite sides of the double-seamed lapped seam portion forming slack curved surfaces continuous to the double-seamed ring portion.

2. The lapped seam can of claim 1 wherein said second end portion is curved inwardly.

3. The lapped seam can of claim 1 wherein said second end portion is outwardly bent.

4. The lapped seam can of claim 1 wherein the second adhesive layer covers the inner and outer surfaces of the second end portion, the width of said adhesive film layers from one side edge to the other side edge thereof being greater than the lapping width, and the end of said first adhesive film stuck onto the inner surface of said inner end portion of the can blank and the end of said second adhesive film stuck onto the outer surface of said outer end portion of the can blank being disposed within the range of the lapping width excluding certain zones inside the opposite limit ends of the lapping width and adjacent thereto in such a manner that said ends of the first and second adhesive films face each other within another zone defined between a position where the plane including the axis of the can intersects the overlapped surfaces of said films and the positions spaced apart in the opposite directions by one-fifth of the maximum lapping width from said position of said plane.

5. The lapped seam can of claim 1, wherein the end portion of the can blank coming outside of the lapped seam has an inclined surface terminating in an end face which has a thickness about one-third of the original thickness of the can blank.

* * * * *